United States Patent [19]

Bacchio

[11] Patent Number: 4,817,246

[45] Date of Patent: Apr. 4, 1989

[54] ROLL CARDING UNIT

[75] Inventor: Giovanni Bacchio, Mongrando, Italy

[73] Assignee: Fonderie Officine Riunite F.O.R. Ing. Graziano di L. Graziano & C. S.A.S., Biella, Italy

[21] Appl. No.: 85,376

[22] Filed: Aug. 14, 1987

[30] Foreign Application Priority Data

Sep. 10, 1986 [IT] Italy ..... 67701 A/86

[51] Int. Cl.[4] ..... D01G 15/32

[52] U.S. Cl. ..... 19/98; 19/100; 19/101

[58] Field of Search ..... 19/98, 99, 100, 101

[56] References Cited

U.S. PATENT DOCUMENTS

| | | | |
|---|---|---|---|
| 2,243,685 | 5/1941 | Schiessler | 19/100 |
| 2,788,547 | 4/1957 | Kaufman et al. | 19/98 X |
| 3,858,276 | 1/1975 | Hollingsworth | 19/98 |
| 4,011,631 | 3/1977 | Estebanell | 19/100 |

FOREIGN PATENT DOCUMENTS

| | | | |
|---|---|---|---|
| 0652059 | 1/1963 | Italy | 19/99 |
| 0010988 | 3/1905 | United Kingdom | 19/101 |

*Primary Examiner*—Louis K. Rimrodt

*Attorney, Agent, or Firm*—Birch, Stewart, Kolasch & Birch

[57] ABSTRACT

A roll carding unit, particularly for processing synthetic fibers for the production of non-woven textiles which includes a high-speed rotary drum and at least one worker roll rotating tangentially to the drum at a much lower speed than the latter to take up and card the fibres. Each worker roll is associated with two tile-shaped members which are disposed adjacent the surface of the drum upstream and downstream respectively of the position at which the latter touches the worker roll. The first member comprises an output section extending close to the zone of touching to convey the flow of fibers thereto and the second member comprises an input section at an angle to the surface of the drum to connect it with the surface of the worker roll.

5 Claims, 3 Drawing Sheets

ROLL CARDING UNIT

The present invention relates to roll carding units in general, particularly for processing synthetic fibers for the production of non-woven textiles.

More particularly, the present invention relates to a carding unit of the type comprising a high-speed rotary drum for drawing the fiber, a licker-in roll rotating tangentially to the input of the loader drum to load the fibers onto the surface thereof, a comber roll rotating tangentially to the output of the drum to unload the fibers from the surface thereof by condensation, at least one worker roll rotating tangentially to the drum at a speed considerably less than the speed of the latter, and disposed between the licker-in and comber rolls to take up some of the fibers from the surface of the drum by condensation and to card these fibers, and auxiliary means for facilitating the loading of the fibers onto the or each worker roll and their removal therefrom.

In the prior art shown diagrammatically in FIG. 1, the auxiliary means are constituted by a clearer roll D rotating tangentially to the drum B and the corresponding worker roll C upstream of the zone $T_1$ in which the worker roll C and the drum B touch. The (or each) clearer roll D has a smaller diameter than that of the worker roll C which in turn is smaller than that of the drum B, and a peripheral velocity greater than that of the worker roll C but less than that of the drum B. The points at which the clearer roll D and the worker roll C touch the drum B are indicated $T_2$, $T_3$ respectively.

In operation, at the point of touching $T_1$, the worker roll C, which rotates in the opposite sense to the direction of advance F of the fibers and at a considerably lower speed than the drum B, loads the drum B by condensation of some of the fibers with which it is loaded. These fibers are combed and remain on the surface of the worker roll C.

At the point of touching $T_2$, the points of the saw-toothed coverings of the lateral surfaces of the clearer roll D (which have vertices opposing the direction of advance F of the fibers and rotate in the opposite means to the direction of advance at a greater peripheral velocity than the worker roll C) remove all the fibers combed and collected by the worker roll C.

It is usually necessary for the clearer roller D to effect a strong drawing action on the worker roll C so that the fibers penetrate the grooves of the coverings and are not blown away by the flow of air caused by the high speed of rotation of the drum B.

Simultaneously, the fiber which have already been combed advance on the surface of the drum B towards its output, that is, towards the comber roll, indicated E, while the fibers amassed between them are taken up again by the worker roll C.

At the point of touching $T_3$, the points of the coverings of the clearer roll D, having vertices and senses of rotation opposite those of the drum B and a lower peripheral velocity, are completely unloaded by the coverings of the drum B.

This type of conventional solution has various disadvantges and limitations which may be summarised as follows:

high air pressures occur within the triangle defined by the points of touching $T_1$, $T_2$, $T_3$ due to the fast rotation of the drum B. This action disturbs the fibers and reduces the combing action effected previously;

in order to limit this harmful effect, attempts have been made to reduce the distances between the three points of touching to a minimum by forming clearer rolls D with the smallest diameter possible. This prevents the achievement of high working rates, however, in that this would result in unacceptable flexural deformation of each clearer roll D;

each clearer roll D, in returning the fibers to the drum B, leaves them on the surface thereof with the disadvantage, particularly for highly cracked fibers, of making them be taken up again by the subsequent worker roll C, because they have a width greater than the distance between the worker roll C and the drum B, instead of their continuing as already carded fibers, as would be more desirable. This causes, therefore, anomalous accumulations of the fibers on the worker roll C and breaking of the fibers themselves.

The object of the present invention is to avoid these disadvantages and in particular to eliminate the clearer rolls D by replacing them with means for achieving the same effect with greater efficiency and without the disadvantages mentioned above.

In order to achieve this object, the present invention provides a roll worker unit, particularly for non-woven textiles, of the type defined above, characterised in that the auxiliary means for facilitating the loading of the fibers onto each worker roll and their removal therefrom comprise first and second tile-shaped members extending parallel to and adjacent the surface of the drum upstream and downstream respectively of the position at which each worker roll touches the drum, relative to the sense of rotation of the latter, and in which the upstream tile-shaped member includes an output section extending close to the zone of touching in order to convey the flow of fibers thereto, and the downstream tile-shaped member includes an input section at an angle to the surface of the drum to connect it to the surface of the worker roll.

By virtue of this solution, the entire process of loading, carding and unloading each worker roll C occurs at the zone in which it touches the drum B. In practice, the output section of the tile-shaped member upstream of the zone of touching keeps the fibers on the surface of the drum B and, by using the pressure created within it, increases the compression of the fibres against the points of the coverings of the worker roll C during loading of the fibers. On the other hand, the input section of the tile-shaped member disposed downstream of the zone of touching prevents dispersion of the fibers and creates a low pressure by the Venturi effect, which sucks all the fibers from the surface of the worker roll C and prevents them from returning to the zone in which the worker roll C touches the drum B.

Furthermore, the removal of the clearer roll D associated with each worker roll C dispenses with the limitations on the dimensions of the unit in view of an increase in the width of working, and eliminates the zones of air pressure loss between each worker roll C and the drum B which could disturb and amass the already combed fibers in a non-homogeneous manner.

A further advantage of the present invention lies in the fact that the highly-cracked fibers do not return to the zone of touching between each worker roll C and the drum B by travelling a reverse path to their direction of advance on the back of the worker roll C, but always proceed in the natural direction of advance.

Preferably, the upstream and downstream tile-shaped members have identical shapes and the input section and output section of each tile are connected by an elongate, curved intermediate section having a radius of curvature corresponding to that of the drum.

Conveniently, the output section of each tile is bevelled, while the input section has a terminal portion at its free end which is bent at an angle to one side of the intermediate section.

To advantage, the tile-shaped members may be adjustable to vary their distances from the surface of the drum.

Further characteristics and advantages of the present invention will become evident during the detailed description which follows with reference to the appended drawings, provided purely by way of non-limiting example, in which.

Figure 1:
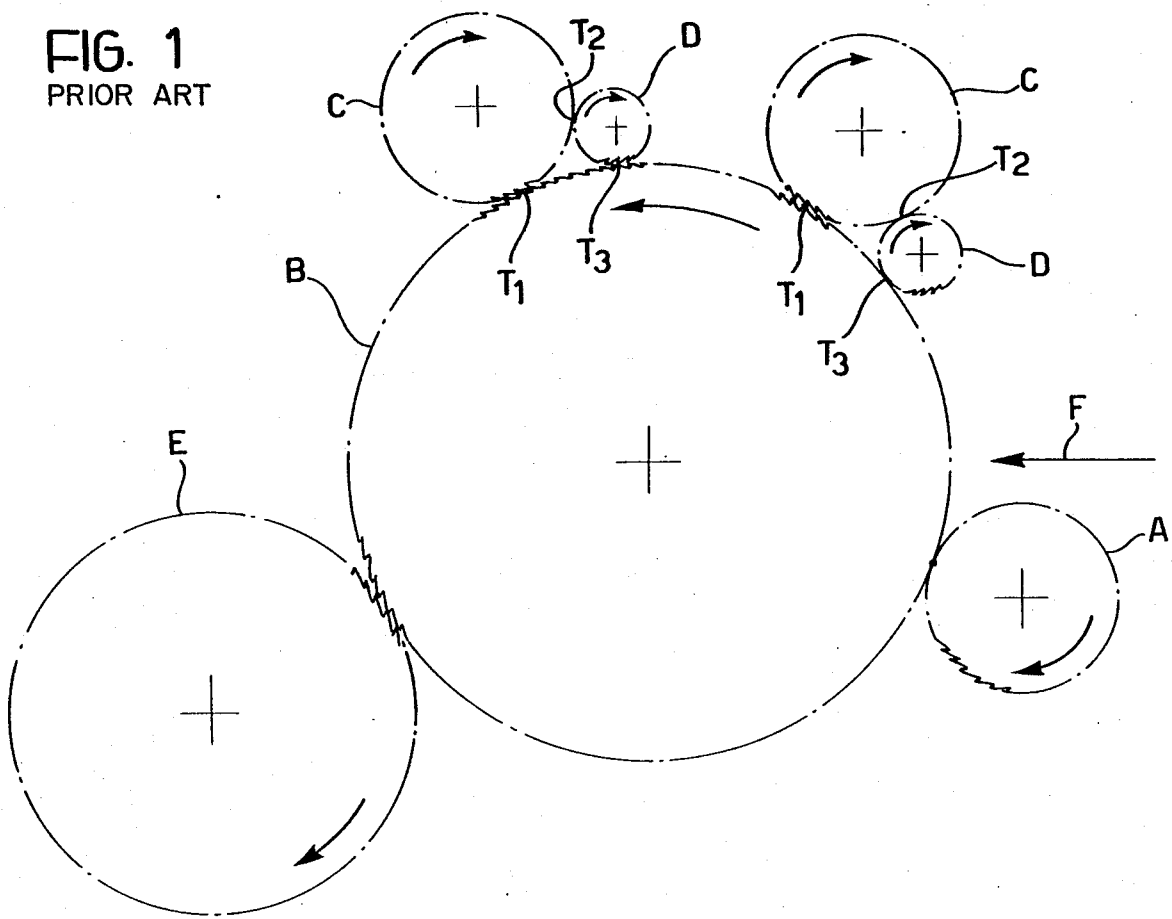
FIG. 1 PRIOR ART
FIG. 1 is a schematic view of a carding unit according to the prior art.
Figure 2:
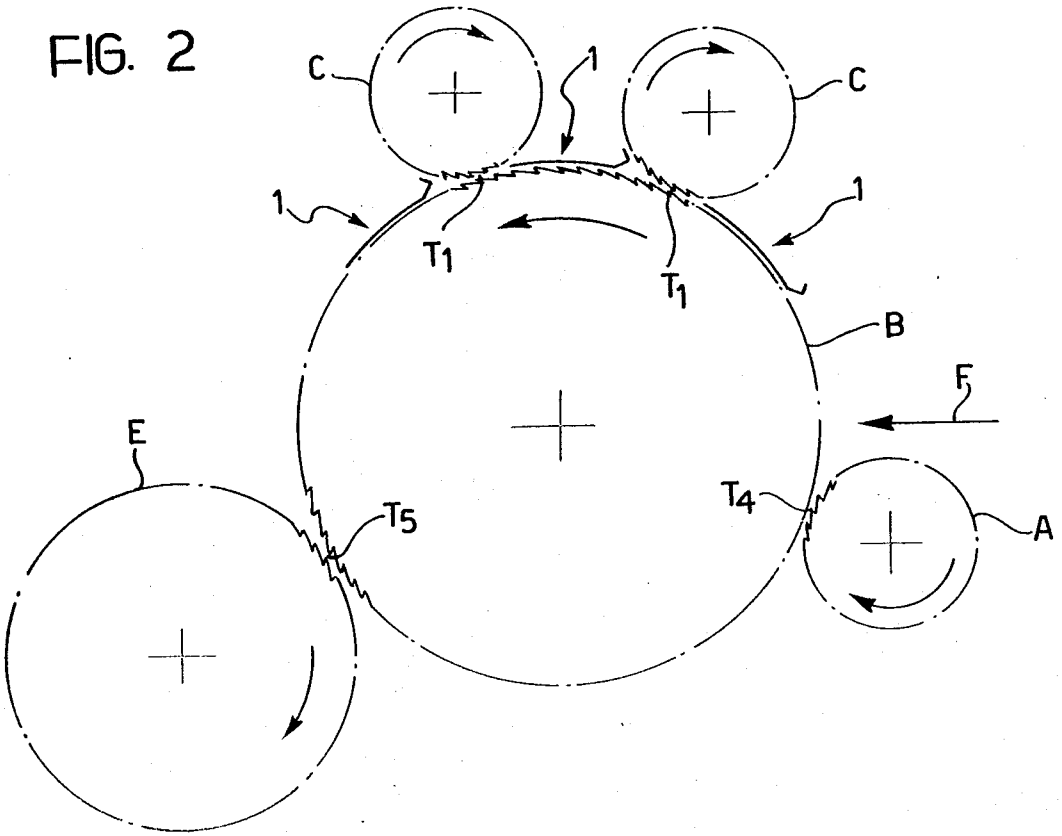
FIG. 2 is a schematic view of a roll worker unit according to the The present invention invention.
Figure 3:
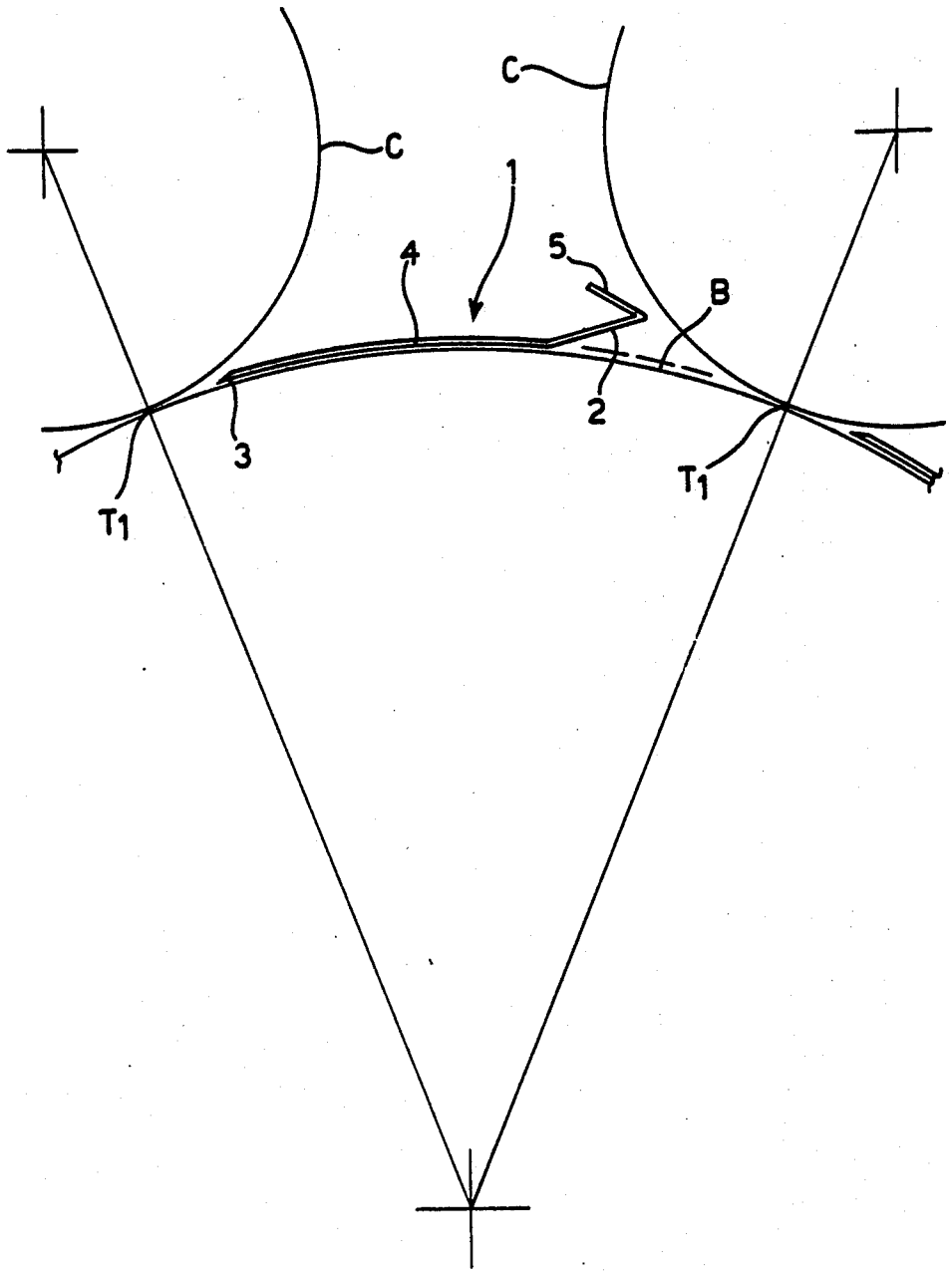
FIG. 3 is an enlarged detail of FIG. 2.

The components of the worker unit according to the invention illustrated in FIGS. 2 and 3 and common to those of the conventional worker unit of FIG. 1 are indicated by the same references.

These components include a drum B constituted by a rotating cylinder with a high peripheral velocity (400–1500 meters per minute) in the direction of advance F of the fibers and covered with saw-toothed coverings with the points facing in the direction of its sense of rotation. This drum has the task of bringing the fibers into contact with the various worker members described below and is supplied by a licker-in member A which may be constituted by a supply or opening roll arranged to control and meter the staple fibers or by a conveyor roll arranged to transfer the partially combed fibers from an upstream carding unit. The zone of touching $T_4$ between the licker-in member A and the drum B constitutes the input to the drum B, while its output is defined by the zone of touching $T_5$ between the drum B and a combing roll E disposed downstream of the worker members. This combing roll E has a diameter of about the same as that of the drum B and is rotated at a much lower peripheral velocity. It is covered with saw-toothed coverings the points of which face in the direction of advance of the fibers but it rotates in the opposite sense. The removal of the carded fibers from the drum B by the combing roll E occurs by condensation as a result of the considerable difference in peripheral velocities, with the aid of strong centrigual forces resulting from the high speed of rotation of the drum B.

Between the licker-in member A and the combing roll E is a series of worker rolls C (two in the embodiment illustrated) each of which touches the drum B at $T_1$ and has a diameter and a peripheral velocity considerably less than those of the drum itself. Each worker roll C is covered with saw-toothed coverings with points facing towards the direction of advance F of the fibers, while its motion is opposite to this direction of advance. Thus, each worker roll C presents opposing points at the point of touching $T_1$ with the drum B.

The function of the worker rolls C is to card, that is, comb and even out, the fibers. In effect, each worker roll C, by rotating in the opposite sense to the direction F of advance of the fibers and at a lower velocity than the drum B, is loaded with some of the fibers with which the drum B is loaded by condensation at the zone of touching $T_1$ due to the conformation of the coverings. These fibers are combed and remain on the surface of the worker roll C.

In order to facilitate the loading and unloading of the fibers relative to each worker roll C, the carding unit according to the present invention uses a pair of tile-shaped members 1 disposed upstream and downstream respectively of the zone of touching $T_1$ between the worker roll C and the drum B, instead of the conventional clearer roll D.

The two tiles 1 conveniently have identical forms and, as illustrated in greater detail in FIG. 3, each comprise a cover of metal or other suitable material which extends parallel to and adjacent the surface of the drum B. With reference to the sense of rotation of the drum B, each tile 1 has an initial section 2 and a final section 3 connected together by an elongate intermediate section 4 having a curved shape with a radius of curvature corresponding to that of the drum B.

The initial section 2 is substantially flat and forms an angle with the intermediate section 4 so as to diverge outwardly from the surface of the drum B. The free end of the initial section 2 has an end portion 5 which is bent at an angle to one side of the intermediate section 4.

In practice, the final section 3 is constituted by a bevelled end of the intermediate portion 4.

With reference to the embodiment illustrated, of the two tiles 1 associated with the left-hand worker roll C, the one upstream of the zone of touching $T_1$ constitutes the input tile and the one downstream of the zone of touching $T_1$ constitutes the output tile, respectively. The input tile 1 of the left-hand worker roll C also constitutes the output tile of the right-hand worker roll C in the drawing, which is associated with the input tile 1 disposed upstream of the zone of touching $T_1$ between this right-hand worker roll and the drum B.

If the two tiles 1 of each pair are considered, it can be seen that the final section 3 of the upstream tile 1 extends so as to be close to the zone of touching $T_1$, while the initial section 2 of the downstream tile connects the lateral surface of the worker roll 5 to the lateral surface of the drum B.

The function of the two tiles 1 associated with each worker roll C is as follows.

The fibers entrained by the drum B (or coming from a previous worker roll C) are conveyed to the zone of touching $T_1$ across the upstream tile 1. This tile 1 keeps the fibers on the surface of the drum B and conveys the flow across the final section 3 to the exact point of touching T, avoiding loss of material.

At the zone of touching $T_1$, the loading of the fibers by condensation occurs and they are thus carded, that is, combed and evened out.

The combed fibers are then returned during rotation of the worker roll C towards the zone of touching $T_1$, where they are removed from the surface of the worker roll C and unloaded again onto the surface of the drum B. This unloading is achieved by virtue of the aerodynamic centrifugal expansion due to the peripheral velocity of the drum B in correspondence with the initial section 2 of the downstream tile 1. In this initial section 2, a low pressure is generated, in practice by the Venturi effect, and tends to make the fibers adhere to the surface of the drum B. The intermediate section 4 of the downstream tile 1 sucks the fibres from the surface of the worker roll C to prevent their return to the point of touching T and avoid their dispersion.

It should be noted that the distance of the tiles 1 from the surface of the drum B may be adjustable by means of simple devices, not illustrated, within the competence of an expert in the art, just as provision could be made for a variation in the relative angular position of the tile itself and the drum B.

I claim:

1. A roll carding unit for processing fibers for the production of non-woven textiles consisting essentially of a high-speed rotary drum for drawing the fibers, a licker-in roll rotating tangentially to the input to the drum to load the fibers onto the surface thereof, a combing roll rotating tangentially to the output of the drum to remove the fibers from the surface thereof by condensation, at least one worker roll rotating tangentially to the drum and at a speed considerably less than the speed of said drum, said worker roller being disposed between the licker-in roll and combing roll to take up some of the fibers from the surface of the drum by condensation and to card these fibers, and auxiliary means for facilitating the loading of the fibers onto each worker roll and facilitating their removal therefrom, said auxiliary means comprising first and second tile-shaped members extending parallel to and adjacent the surface of the drum and disposed upstream and downstream respectively of the zone at which each of said worker rolls touches the drum, relative to the sense of rotation thereof, said upstream tile-shaped member including an input and output section, said output section extending close to the zone of touching in order to convey the flow of fibers thereto and the downstream tile-shaped member including an input and output section said input section being disposed at an angle to the surface to the drum and extending toward the surface of the worker roll to direct the fibers to the surface of the worker roll.

2. The carding unit according to claim 1, wherein the upstream and downstream tile-shaped members are of an identical shape and further comprising an elongated, curved intermediate section having a radius of curvature corresponding to that of the drum and connecting the input section of the tile-shaped member with the output section of the tile-shaped member.

3. The carding unit according to claim 2, wherein the output section of each tile-shaped member is bevelled.

4. Carding unit according to claim 3, wherein the input section of each tile-shaped member has, at its free end, a terminal portion bent at an angle to one side of the intermediate section.

5. The carding unit according to claim 2, wherein the input section of each tile-shaped member has, at its free end, a terminal portion bent at an angle to one side of the intermediate section.

* * * * *